US006789308B2

(12) United States Patent
Takaba et al.

(10) Patent No.: US 6,789,308 B2
(45) Date of Patent: Sep. 14, 2004

(54) METHOD OF MANUFACTURING FLAT ANTENNA

(75) Inventors: Shinichi Takaba, Tokyo (JP); Takahiro Sugiyama, Tokyo (JP); Shinichiro Suzuki, Tokyo (JP); Morihiko Ikegaya, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 154 days.

(21) Appl. No.: 10/170,417

(22) Filed: Jun. 14, 2002

(65) Prior Publication Data

US 2003/0135982 A1 Jul. 24, 2003

(30) Foreign Application Priority Data

Jan. 24, 2002 (JP) ..... 2002-015637

(51) Int. Cl.[7] ..... H01Q 13/00

(52) U.S. Cl. ..... 29/600; 29/602.1; 29/601; 29/846; 29/853; 29/844; 29/882

(58) Field of Search ..... 29/600, 602.1, 29/601, 846, 853, 844, 882; 72/46, 47

(56) References Cited

U.S. PATENT DOCUMENTS

| | | | | | |
|---|---|---|---|---|---|
| 3,780,247 | A | | 12/1973 | Healy et al. | |
| 3,797,108 | A | | 3/1974 | Healy et al. | |
| 3,859,558 | A | * | 1/1975 | Harada et al. | 315/39.51 |
| 4,626,957 | A | * | 12/1986 | Kaneko et al. | 361/275.1 |
| 4,838,815 | A | * | 6/1989 | Tajima et al. | 439/841 |
| 5,045,973 | A | * | 9/1991 | Saarela et al. | 361/814 |
| 5,220,338 | A | * | 6/1993 | Matsushita | 343/787 |
| 5,896,112 | A | * | 4/1999 | Bickford et al. | 343/872 |
| 5,936,590 | A | * | 8/1999 | Funder | 343/795 |
| 6,008,763 | A | * | 12/1999 | Nystrom et al. | 343/700 MS |
| 2001/0005183 | A1 | | 6/2001 | Nevermann et al. | |
| 2002/0004344 | A1 | | 1/2002 | Keiser et al. | |

FOREIGN PATENT DOCUMENTS

| | | |
|---|---|---|
| EP | 0 623 957 A1 | 11/1994 |
| EP | 0 893 841 A1 | 1/1999 |
| EP | 1 122 811 A1 | 8/2001 |
| WO | WO 01/57951 A1 | 8/2001 |

* cited by examiner

*Primary Examiner*—Carl J. Arbes
*Assistant Examiner*—Tai Van Nguyen
(74) *Attorney, Agent, or Firm*—Foley & Lardner LLP

(57) ABSTRACT

A method of manufacturing a flat antenna is composed of the steps of entirely applying Ni plating to the front and back surfaces of a long metal sheet, bonding masking tapes to the front surface of the metal sheet where the Ni plating has been applied except two stripe regions, applying Au plating to the two stripe regions by dipping the metal sheet into an Au plating solution, making a plurality of conductive flat sheets by punching the metal sheet to a plurality of regions along the lengthwise direction thereof after exfoliating the masking tapes, and bending the portions of each conductive flat sheet acting as a power feed terminal and a ground terminal. The metal sheet can be simply masked by bonding a plurality of the masking tapes thereto linearly except the regions where the plating is to be applied, thereby the productivity of the flat antenna can be increased.

9 Claims, 4 Drawing Sheets

METHOD OF MANUFACTURING FLAT ANTENNA

BACKGROUND OF THE INVENTION

1. Field of the Invention

The present invention relates to a method of manufacturing a flat antenna contained in a mobile terminal such as a mobile phone (including PHS), a mobile radio, a note type personal computer, and the like, and more particularly, to a more productive method of manufacturing a flat antenna.

2. Prioir Art

There is known, as a conventional antenna contained in a mobile terminal, an antenna composed of, for example, a printed circuit board on which a conductive pattern having a power feeder and a ground are formed with the power feed terminal and the ground terminal of the antenna abutted against the power feeder and the ground, respectively making use of the elasticity of the antenna. This antenna is gold plated only at the terminals of a metal sheet used as a material thereof to stabilize the conductivity of contacts. The cost of the antenna can be reduced by applying gold plating only to necessary portions.

To apply gold plating only to the terminals of the metal sheet as described above, there is conventionally employed a method of punching and molding a metal sheet, hooking respective molded products on jigs, and dipping only the terminals of the molded products at the extreme ends thereof in a plating solution (first method).

Else, a method of masking a metal sheet at a plurality of positions such that plating is applied only to the terminals of the metal sheet before it is punched (second method).

According to the conventional antenna, however, the first method is not suitable for mass-production because it is very time consuming to hook the molded products on the jigs individually. Further, the second method requires a performance of time-consuming job for masking the metal sheet individually.

SUMMARY OF THE INVENTION

Accordingly, an object of the present invention is to provide a more productive method of manufacturing a flat antenna.

To achieve the above object, the present invention provides a method of manufacturing a flat antenna including the steps of applying strip-shaped plating to the front surface of a metal sheet, punching the metal sheet, and arranging a portion of the strip-shaped plated portion of the punched metal sheet as a plurality of terminals.

According to this arrangement, the strip-shaped plating is applied to the front surface of the plurality of terminals by dipping the metal sheet into a plating solution after a masking tape or a plurality of masking tapes have been bonded to the metal sheet.

To achieve the above object, the present invention provides a method of manufacturing a flat antenna having the steps of applying strip-shaped plating to the front surface of a long metal sheet along the lengthwise direction thereof, punching the metal sheet at a plurality of positions in the lengthwise direction thereof, and arranging a portion of the strip-shaped plating of each of the metal sheets punched at the plurality of positions as a plurality of terminals.

According to this arrangement, the productivity of the flat antenna can be improved by punching the long metal sheet at the plurality of positions sequentially or simultaneously.

The strip-shaped plating may be applied in a plurality of parallel stripes. Corrosion prevention plating may be applied to at least the front and back surfaces of the metal sheet, and then the strip-shape plating may be applied to the corrosion prevention plating of the front surface of the metal sheet. The metal sheet may be punched such that the plurality of terminals project, and then the plurality of terminals are bent. After the metal sheet is punched, the punched metal sheet may be attached to a holder composed of a dielectric material.

BRIEF DESCRIPTION OF THE DRAWINGS

FIGS. 2A to 2C relate to the flat antenna according to the first embodiment of the present invention, wherein FIG. 2A is a plan view of the flat antenna, FIG. 2B is a side elevational view of the flat antenna, and FIG. 2C is a sectional view of the flat antenna taken along the line A—A of FIG. 2A;

FIGS. 3A to 3C relate to a flat antenna according to a second embodiment of the present invention, wherein FIG. 2A is a plan view of the flat antenna, FIG. 2B is a side elevational view of the flat antenna, and FIG. 2C is a sectional view of the flat antenna taken along the line A—A of FIG. 2A.

DESCRIPTION OF THE PREFERRED EMBODIMENTS

Figure 1A:
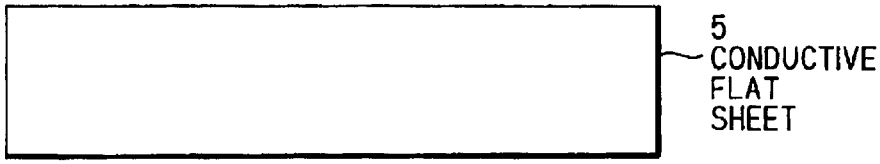
FIGS. 1A to 1F are views showing the processes for manufacturing a flat antenna according to a first embodiment of the present invention.
Figure 1B:
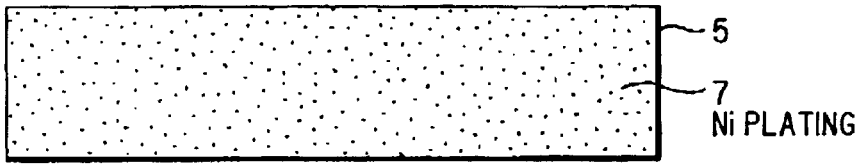
Figure 1C:
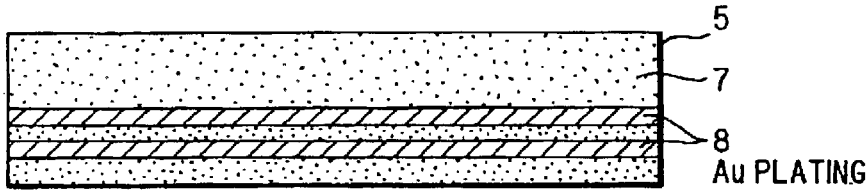
Figure 1D:
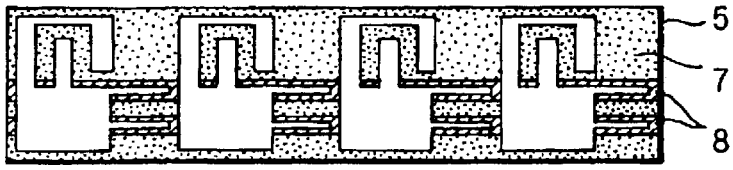
Figure 1E:
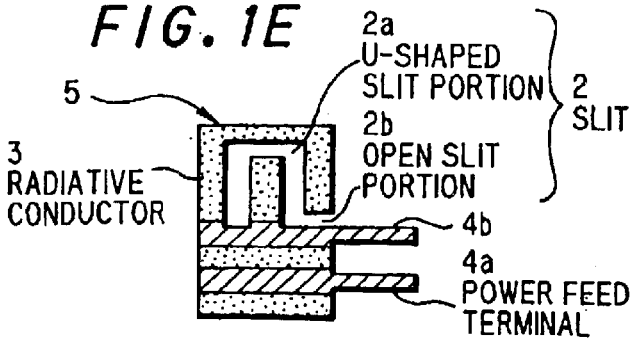
Figure 1F:
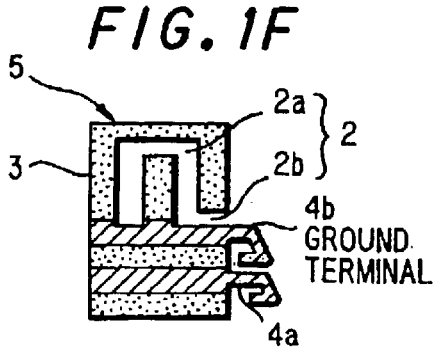

FIGS. 1A to 1F and FIG. 2 show the processes for manufacturing a flat antenna according to a first embodiment of the present invention. First, a long metal sheet 5 is prepared as shown in FIG. 1A, and Ni plating 7 is entirely applied to the front and back surfaces of the metal sheet 5 by dipping it into a Ni plating solution in order to prevent the corrosion thereof as shown in FIG. 1B. Next, masking tapes are bonded to the front surface of the Ni plating 7 except two stripe regions, and Au plating 8 is applied to the two stripe regions by dipping the metal sheet 5 into an Au plating solution as shown in FIG. 1C to stabilize the conductivity of the contacts of the metal sheet 5. Next, the masking tapes are exfoliated from the metal sheet 5, the metal sheet 5 is punched at a plurality of positions sequentially or simultaneously along a lengthwise direction as shown in FIG. 1D, and a plurality of conductive flat sheets 5 are made as shown in FIG., 1E (only one of them is shown in the figure). Next, the conductive flat sheet 5 is bent in a U-shape at the portions thereof acting as a power feed terminal 4*a* and a ground terminal 4*b* as shown in FIG. 1F. Finally, the conductive flat sheet 5 is attached to a holder 6 as shown in FIGS. 2A, 2B, and 2C. The power feed terminal 4*a* and the ground terminal 4*b* of the flat antenna 1 made as described above are electrically connected to a conductive pattern formed on a printed circuit board by solder.

Figure 2A:
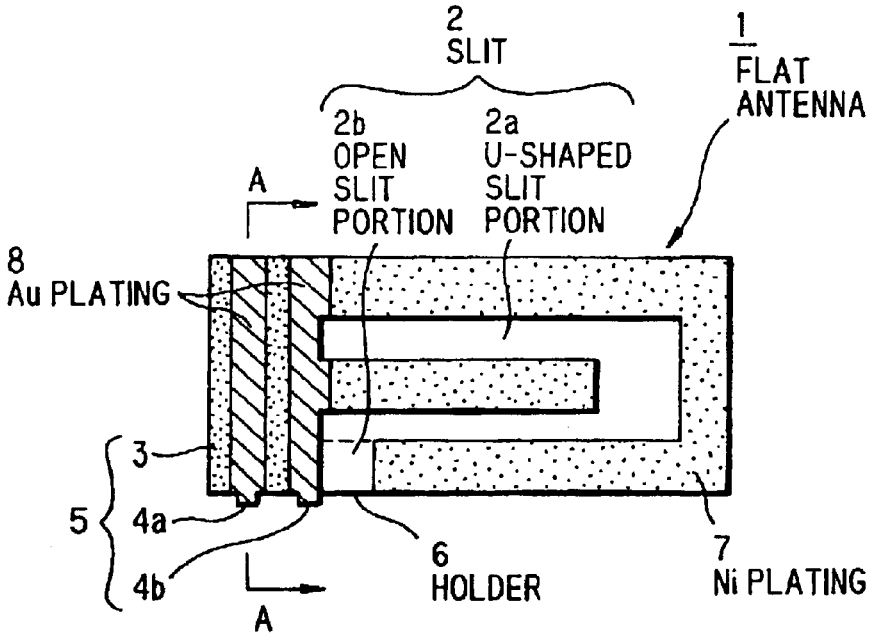
Figure 2B:
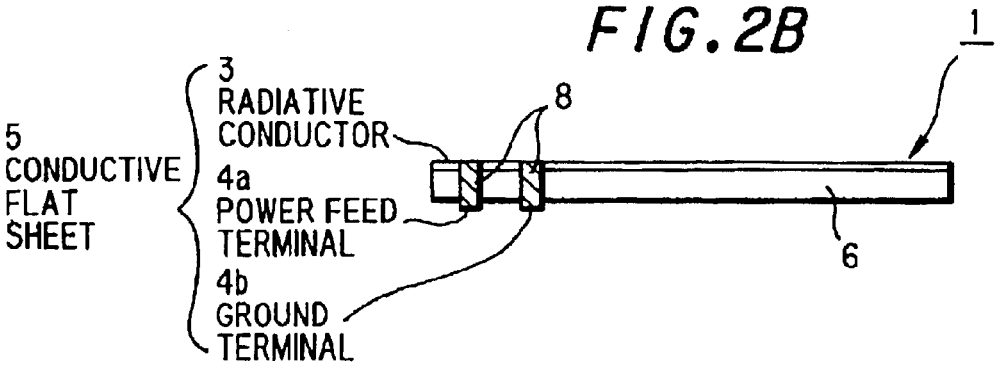
Figure 2C:
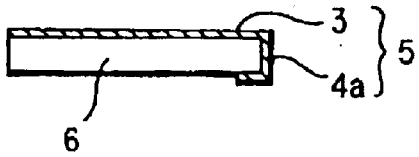

The flat antenna 1 made by the above manufacturing processes includes a slit 2 formed thereto and having an open end as shown in FIG. 2A, and further includes a flat radiative conductor 3 having at least first and second resonant frequencies $f_1$ and $f_2$ ($f_1<f_2$), the conductive flat sheet 5 composed of the power feed terminal 4*a* and the ground terminal 4*b* extending from the radiative conductor 3, and the holder 6 for holding the conductive flat sheet 5.

More than two sets of power feed terminals 4*a* may be provided, In this case, plurality of power feed terminals 4*a* are used according to a frequency being used. Besides, the power feed terminal 4*a* and the ground terminal 4*b* may be disposed inversely.

The metal sheet used as the material of the conductive flat sheet 5 can be composed of copper, phosphor bronze, copper alloy, stainless steel, and the like. Further, the conductive flat sheet 5 is attached to the holder 6 by bonding, fitting, and the like.

It is preferable that the holder 6 be composed of a dielectric material that has a size approximately as large as that of the radiative conductor 3 and a thickness according to the band of the radiative conductor 3 and is light in weight and excellent in heat resistance, and ABS, ABS-PC, and the like, for example, can be used as the holder 6. Note that the material of the holder 6 is not limited thereto and any other materials may be used as long as they can keep the shape of the conductive flat sheet 5.

According to the first embodiment, it is possible to mask the metal sheet by previously bonding a plurality of masking tapes thereto linearly before the metal sheet is punched, thereby the productivity of the flat antenna can be improved by greatly reducing the number of man-hour. Further, since the conductive flat sheet 5 is molded by punching, the dispersion of dimensional accuracy can be suppressed. Further, since the Ni plating 7 is applied to the front and back surfaces of the conductive flat sheet 5, the corrosion thereof can be prevented as well as the dispersion of Au in the Au plating 8 to a metal sheet portion can be prevented.

Figure 3A:
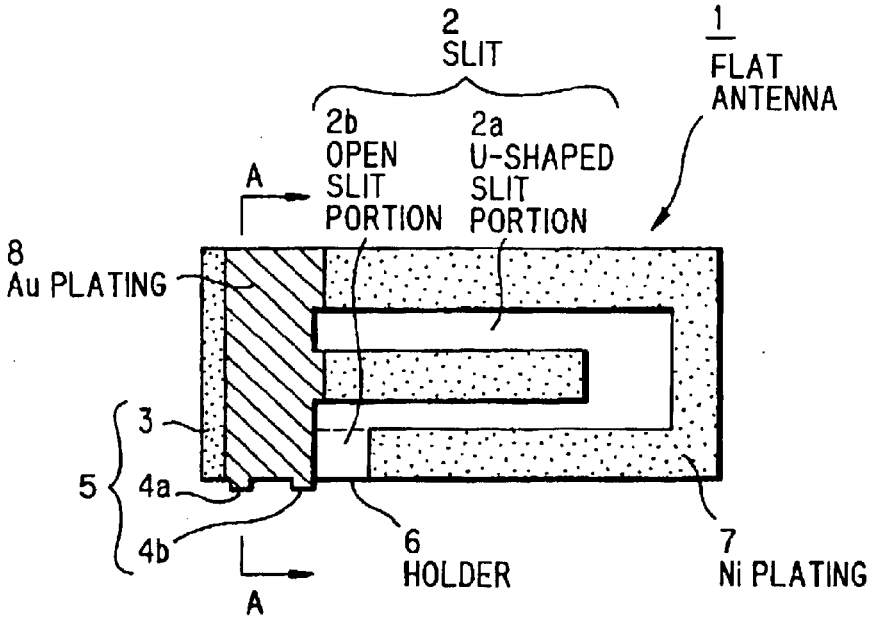
Figure 3B:
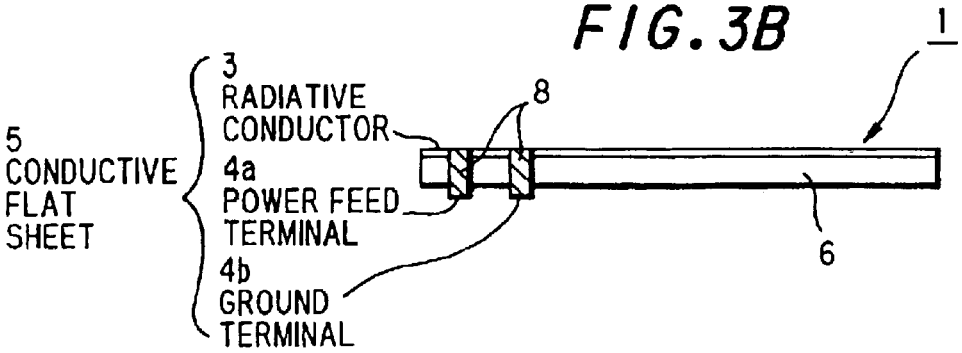
Figure 3C:
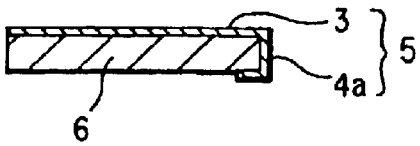

FIGS. 3A and 3B show a flat antenna according to a second embodiment of the present invention. In the first embodiment, the Au plating 8 is applied in the two stripe shapes in the plating process shown in FIG. 1C. The flat antenna 1 according to the second embodiment is made similarly to that of the first embodiment except that Au plating 8 is applied thereto in a single stripe shape in the plating process shown in FIG. 1C. According to the second embodiment, the process for bonding the masking tape can be more easily performed while the area of the metal sheet to which the Au plating 8 is applied is increased as compared with that of the first embodiment.

Figure 4A:
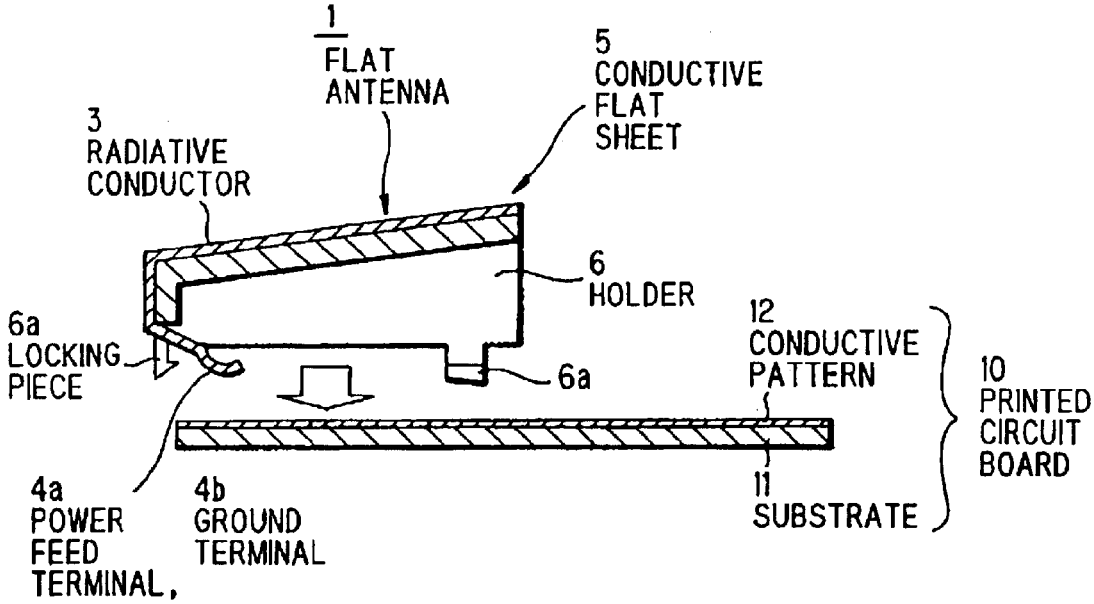
FIGS. 4A and 4B are views showing a flat antenna according to a third embodiment of the present invention.
Figure 4B:
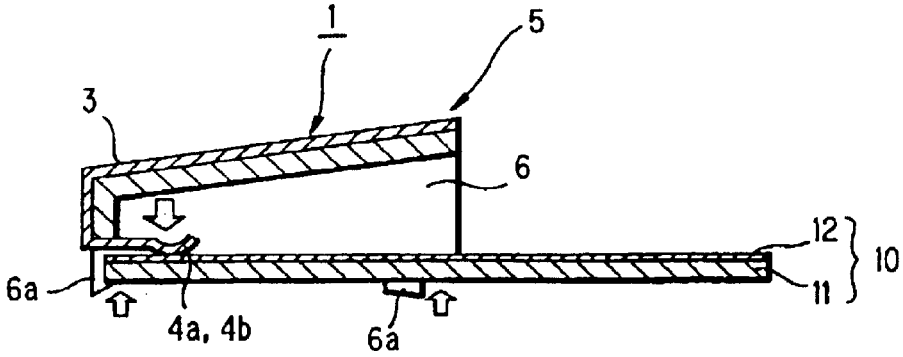

FIGS. 4A and 4B show a flat antenna according to a third embodiment of the present invention. The flat antenna 1 is attached to a printed circuit board 10 having a conductive pattern 12 formed thereon and disposed on a substrate 11 in a mobile phone and includes a holder 6 having a plurality of locking pieces 6*a* and a conductive flat sheet 5 similar to that of the first embodiment and formed on the upper surface of the holder 6. The third embodiment is different from the first embodiment in that a power feed terminal 4*a* and a ground terminal 4*b* are not in intimate contact with the holder 6.

When the flat antenna 1 is attached to the printed circuit board 10, the power feed terminal 4*a* and the ground terminal 4*b* of the flat antenna 1 are abutted against the conductive pattern 12 of the printed circuit board 10 by the elasticity thereof as shown in FIG. 4B by pressing the flat antenna 1 against the printed circuit board 10 as shown by an arrow in FIG. 4A. Thus, the power feed terminal 4*a* and the ground terminal 4*b* are electrically connected to the conductive pattern 12.

According to the third embodiment, since the terminals 4*a* and 4*b* of the flat antenna 1 are electrically connected to the conductive pattern 12 by the elasticity thereof, influence due to heat can be eliminated different from a case in which the terminals 4*a* and 4*b* are connected to the conductive pattern 12 by solder.

The present invention is not limited to the above embodiments and can be variously modified. While the Ni plating is used in the above embodiments as the corrosion prevention plating, other plating such as Au plating may be used. Further, Band-shape plating may be directly applied to the metal plate without applying the corrosion prevention plating thereto. A plastic sheet having plated front and back surfaces may be used as the metal sheet and strip-shaped plating may be applied to the front surface thereof. In this case, the plating applied to the front and back surfaces of the plastic sheet acts as a radiative conductor. A conductive plastic sheet maybe used as the metal sheet and strip-shaped plating may be applied to the front surface thereof. The terminals of the antenna may be electrically connected to the conductive pattern on the printed circuit board through a spring member interposed there between. The Au plating may be applied to both the front and back surfaces of the metal sheet depending upon a direction in which the terminals are connected. Further, there is no need to say that the shape of pattern of the radiative conductor 3 is not limited to that of the above embodiments, and various shapes of pattern may be applied to the present invention.

As described above, according to the present invention, the metal sheet can be easily masked by linearly bonding a masking tape or a plurality of masking tapes thereto except the regions to which plating is to be applied, thereby the productivity of the flat antenna can be increased.

What is claimed is:

1. A method of manufacturing a flat antenna comprising the steps of:

applying strip-shaped plating to a front surface of a metal sheet, and thereby obtaining a strip-shaped plated portion;

punching the metal sheet; and arranging a portion of the strip-shaped plated portion of the punched metal sheet as a plurality of terminals, wherein corrosion prevention plating is applied to at least the front surface and to a back surface of the metal sheet, and then the strip-shaped plating is applied to the corrosion prevention plating of the front surface of the metal sheet.

2. A method of manufacturing a flat antenna according to claim 1, wherein the metal sheet is punched such that the plurality of terminals project, and then the plurality of terminals are bent.

3. A method of manufacturing a flat antenna according to claim 1, wherein after the sheet metal is punched, the punched metal sheet is attached to a holder composed of dielectric material.

4. A method of manufacturing a flat antenna comprising the steps of:

applying strip-shaped plating to a front surface of a metal sheet, and thereby obtaining a strip-shaped plated portion;

punching the metal sheet; and arranging a portion of the strip-shaped plated portion of the punched metal sheet as a plurality of terminals, wherein after the metal sheet is punched, the punched metal sheet is attached to a holder composed of a dielectric material.

5. A method of manufacturing a flat antenna comprising the steps of:

applying strip-shaped plating to a front surface of a long metal sheet along a lengthwise direction thereof, and thereby obtaining a strip-shaped plated portion;

punching the metal sheet at a plurality of positions in the lengthwise direction; and arranging a portion of the strip-shaped plated portion of each of the metal sheets punched at the plurality of positions as a plurality of terminals, wherein corrosion prevention plating is applied to at least the front surface and to a back surface of the metal sheet, and then the strip-shaped plating is applied to the corrosion prevention plating of the front surface of the metal sheet.

6. A method of manufacturing a flat antenna comprising the steps of:

applying strip-shaped plating to a front surface of a metal sheet, and thereby obtaining a strip-shaped plated portion;

punching the metal sheet; and arranging a portion of the strip-shaped plated portion of the punched metal sheet as a plurality of terminals, wherein the strip-shaped plating is applied in a plurality of parallel strips, and wherein corrosion prevention plating is applied to at least the front surface and to a back surface of the metal sheet, and then the strip-shaped plating is applied to the corrosion prevention plating of the front surface of the metal sheet.

7. A method of manufacturing a flat antenna comprising the steps of:

applying strip-shaped plating to a front surface of a long metal sheet along a lengthwise direction thereof, and thereby obtaining a strip-shaped plated portion;

punching the metal sheet at a plurality of positions in the lengthwise direction; and arranging a portion of the strip-shaped plated portion of each of the metal sheets punched at the plurality of positions as a plurality of terminals, wherein after the sheet metal is punched, the punched metal sheet is attached to a holder composed of dielectric material.

8. A method of manufacturing a flat antenna comprising the steps of:

applying strip-shaped plating to a front surface of a metal sheet, and thereby obtaining a strip-shaped plated portion;

punching the metal sheet; and arranging a portion of the strip-shaped plated portion of the punched metal sheet as a plurality of terminals, wherein the strip-shaped plating is applied in a plurality of parallel strips, and wherein after the sheet metal is punched, the punched metal sheet is attached to a holder composed of dielectric material.

9. A method of manufacturing a flat antenna comprising the steps of:

applying strip-shaped plating to a front surface of a metal sheet, and thereby obtaining a strip-shaped plated portion;

punching the metal sheet; and arranging a portion of the strip-shaped plated portion of the punched metal sheet as a plurality of terminals, wherein the metal sheet is punched such that the plurality of terminals project, and then the plurality of terminals are bent, and wherein after the sheet metal is punched, the punched metal sheet is attached to a holder composed of dielectric material.

* * * * *